US009295879B2

(12) United States Patent
Palmer et al.

(10) Patent No.: US 9,295,879 B2
(45) Date of Patent: Mar. 29, 2016

(54) EXERCISE DEVICE AND METHOD OF USING SAME

(71) Applicants: Richard Palmer, Newbury Park, CA (US); John Pertessis, Thousand Oaks, CA (US)

(72) Inventors: Richard Palmer, Newbury Park, CA (US); John Pertessis, Thousand Oaks, CA (US)

( * ) Notice: Subject to any disclaimer, the term of this patent is extended or adjusted under 35 U.S.C. 154(b) by 237 days.

(21) Appl. No.: 13/932,628

(22) Filed: Jul. 1, 2013

(65) Prior Publication Data

US 2014/0005018 A1 Jan. 2, 2014

Related U.S. Application Data

(60) Provisional application No. 61/666,107, filed on Jun. 29, 2012.

(51) Int. Cl.

| | |
|---|---|
| ***A63B 21/00*** | (2006.01) |
| ***A63B 26/00*** | (2006.01) |
| ***A63B 69/00*** | (2006.01) |
| ***A63B 21/02*** | (2006.01) |
| ***A63B 22/16*** | (2006.01) |
| *A63B 71/00* | (2006.01) |

(52) U.S. Cl.

CPC ..... *A63B 26/003* (2013.01); *A63B 21/023* (2013.01); *A63B 22/16* (2013.01); *A63B 69/0093* (2013.01); *A63B 2071/0063* (2013.01)

(58) Field of Classification Search

CPC ..... A63B 21/00
USPC ..... 482/146, 147, 79
See application file for complete search history.

(56) References Cited

U.S. PATENT DOCUMENTS

| | | | | |
|---|---|---|---|---|
| 4,824,101 | A | 4/1989 | Karlas | |
| 5,997,474 | A * | 12/1999 | Batchelor | 600/220 |
| 6,832,979 | B1 | 12/2004 | Yarbrough | |
| 7,070,192 | B1 | 7/2006 | Steiner | |
| 7,500,324 | B1 * | 3/2009 | Power et al. | 36/132 |
| 7,632,218 | B2 * | 12/2009 | Sannes et al. | 482/51 |
| 7,980,573 | B1 | 7/2011 | Naman | |
| D651,677 | S | 1/2012 | Shannon | |
| 2010/0140885 | A1 | 6/2010 | Corrente | |
| 2013/0178346 | A1 * | 7/2013 | Lin | 482/146 |

* cited by examiner

*Primary Examiner* — Jerome W Donnelly
(74) *Attorney, Agent, or Firm* — Kaplan Breyer Schwarz & Ottesen, LLP

(57) ABSTRACT

A system and method are disclosed which may include a training board including a plank made of wood (or other material such as metal, rubber or plastic) and deformable or non-deformable structures coupled to a bottom thereof, thereby enabling the board to rotate about as many as three rotational axes upon having force applied thereto by a user. The training board may enable a user to use to the board for training purposes or recreational activities using structures having a range of properties.

17 Claims, 7 Drawing Sheets

EXERCISE DEVICE AND METHOD OF USING SAME

CROSS-REFERENCE TO RELATED INVENTIONS

This application claims the benefit of U.S. Provisional Patent Application Ser. No. 61/666,107, filed Jun. 29, 2012, entitled "Exercise Device And Method of using Same" the entire disclosure of which application is hereby incorporated by reference herein.

BACKGROUND OF THE INVENTION

Various devices have been used as training aides by people for training various muscle groups. Such devices may be expensive and cumbersome, and thereby require users to drive to a gym or other established facility to use the various devices. Accordingly, there is a need in the art for an improved system and method for training for balance, posture, among other athletic attributes.

SUMMARY OF THE INVENTION

According to one aspect, the invention is directed to a rectangular board with spherically shaped balls affixed thereto. A rectangular training board may provide multiple planes of motion, thereby providing challenging training for a person using the training board. The apparatus will help facilitate balance, proprioceptive training, postural reactions, coordinated muscle response, muscle strengthening, quickens reflex time and helps improve athletic ability and performance.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PREFERRED EMBODIMENTS

Figure 1A:
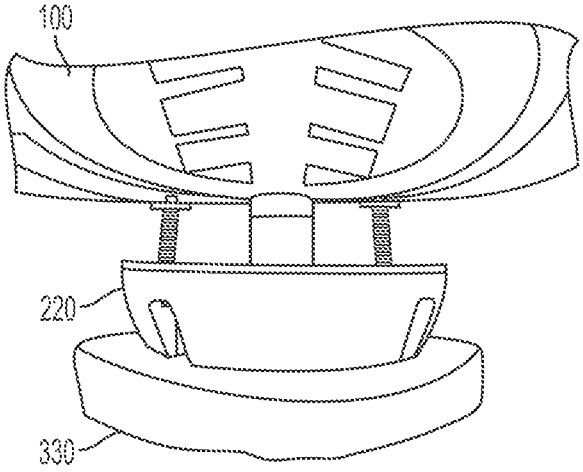
FIG. 1A is a frontal view of a portion of a training device in accordance with an embodiment of the present invention.

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

The training board disclosed herein may be an unstable, sensory stimulating rectangular "skate-board-shape" board, which may be used as a rocking board, or as a wobble board or fitness device.

The stator 20 (which may include all parts in the training device 10 other than the board 100, anchor assembly 110 and stabilizers screws 122, 124 and stabilizer holes 1216, 128) may be made of the following materials: wood, metal, plastic and/or rubber. Moreover, any synthetic material may be included in the composition of the stator. Basically, the stator can be made of any material that is rigid or pliable. The board can also be made of any rigid or pliable material including wood or plastic. The stator 20 may include suspension linkage 200 and base 300.

A training board assembly 10 (also referred to as training device 10) according to an embodiment of the invention may include a rectangular board similar in shape and size to a skate board, and may be made of wood, metal, plastic, rubber, high density polyethylene filled with structural urethane or any natural or synthetic materials. Alternatively, the training board may be made of a combination of one or more of the above-listed materials. The training board assembly 10 preferably has one or more deformable or non-deformable structures affixed to a bottom surface thereof, to enable the training board to rotate about one or more axes (up to three axes in some embodiments) when a user is using the training board assembly. In this way, the training board assembly disclosed can emulate the operation of a skateboard or surfboard by responding to and partially resisting the forces imparted to the board by a user.

A training board assembly 10 according to the present invention may be made available with various widths and lengths of the boards themselves and with varying dimensions of the deformable bodies/structures (which may, but need not, be spherical) that may be affixed to the boards. The deformable bodies (also referred to herein as deformable members or "stators") located at the bottom of the training board may be permanently attached to the bottom surface of the board, or may instead be removeably attached to the boards, thereby enabling a single board to be used with a range of different deformable bodies (or stators) having different operational characteristics.

The deformable structures may be made of wood, plastic, rubber or any natural or synthetic material, or any combination of one or more of the above-mentioned materials and may be spherical, cylindrical or disk shaped.

One embodiment of training device 10 may include inserts for attaching interchangeable balls or stators (which may be spherical) to bottoms of the rectangular boards. The balls or stators may have a range of sizes and shapes. The inserts may be made of various materials including but not limited to: metal, plastic or any synthetic material. The insert may be employed along with a surface that can serve as a mount to which the deformable bodies, balls (which may be spherical), or stators can be attached. Springs having a wide range of compression coefficients may be used within the stators 20. For example, the springs may spring constants from 5 pounds per inch on up to 400 pounds per inch or higher if needed.

One embodiment of the training board assembly may include mounts made of metal, wood, plastic, rubber, or any synthetic material may be used to attach the multi-sized balls/spheres to the boards. (Herein, the term "stator" may be used to refer to an entirety of a training board other than the board itself and anchor(s) and stabilizer(s), if present on the training board). One embodiment may include the use of a slip-resistant, textured top surface which may be deployed to prevent foot shifting or slippage. In an embodiment, the deformable bodies may include embedded compression-loaded springs or coils. Indicia of trademark or branding and/or art work may be applied to the tops and bottoms of the rectangular boards. In an embodiment, training device 10 may have compression loaded coil springs embedded into the stators 20.

Various Applications:

A training device 10 according to an embodiment of the present invention may be used either for training or as a sport/recreational activity in itself. The board may be used to improve balance through proprioceptive training, postural reactions, and/or coordinated muscle response. The board may be used to strengthen and condition athletes through muscle response. The board may be used to quicken reflex time and to help improve athletic ability and performance.

A training device according to an embodiment of the present invention may be used as a training tool for skateboarding, waterboarding, or snowboarding as a therapeutic tool for conditioning or reconditioning the neural/muscular/skeletal body system; as an improved strength and conditioning tool, as in improved balance tool, and/or as sport activity equipment (in competitive and/or recreational sports).

A training device 10 according to an embodiment of the present invention may be used as sports equipment that emulates skateboard, waterboard, or snowboard functionality and performance. Further, use of embodiments of the invention discussed herein may improve the safety of the use of skateboards, wakeboards, snowboards. This improved safety may arise from the use of compliant material for a "shoe" 330 which is effective for emulating the operational characteristics of a real skateboard in a stationary position on the ground, and to thereby effectively train the user in the safe operation of a skateboard while the user is an a safe and controlled environment.

An embodiment of the training device 10 disclosed herein may enable a user to emulate the movements, muscle training, coordination, and timing factors present in conventional skateboarding, but in a safer manner. Specifically, while the training device may be mobile rotationally about one, two, or three axes, and may vertically with respect to the ground or other support surface, there is no significant forward motion. Thus, the risk of collision with vehicles on the street, or with people, is absent. Moreover, the risk of injury upon falling off the board can be minimized by selecting soft, safe surfaces about the periphery of the board to minimize the impact arising from a user falling off the training board. Thus, a training board according an embodiment of the present invention can enable a user to rival and possibly surpass the training value of a mobile skateboard while using a mostly stationary board.

A board according to an embodiment of the present invention may operate as a therapeutic tool that can function as a wobble or roller board. The board may incorporate springs, and/or stationary or rotating balls. The board may include stationary substantially spherical deformable bodies that can be inflated to adjust the bounce and/or tension desired by the user of the training board. The board according to an embodiment of the present invention may include rotating balls (or, rotating stators) that can rotate in one or many planes relative to the board.

In one embodiment, stabilizers extending from the board to a top ring of the stator may operate to control any of the roll, pitch, and/or yaw of the board 100 with respect to the stator 20. In one embodiment, the stabilizers could control the roll (rotation of the board about the longitudinal axis of the training device) and yaw of the board with respect to the stator, but allow the pitch angle (i.e. the forward-backward tilt of the board 100 with respect to the base 300) to vary. In another embodiment, the yaw and pitch angles of the board with respect to the stator could be controlled, while the roll angle could be controlled. In another embodiment, the yaw angle between the board and the stator could be controlled, but the board could be permitted to rotate along the roll and pitch angles with respect to the stator of the training device.

Training Board Features:

A training board according to an embodiment of the present invention may include one or more of the following features.

(1) Spherical, cylindrical or disk shaped balls may be attached to a rectangular board for the purpose of creating an apparatus that could be used for therapeutic, conditioning, strengthening, training or sport activities in a safe manner.

(2) Deformable or non-deformable structures (which may be substantially spherical, cylindrical or disk shaped) may be permanently attached to a flat wooden board, or can be removeably attached to a board so that different deformable structures may be attached to the same board.

3) A training board may be assembled such that the deformable structures (which may be spherical, cylindrical or disk shaped) are static (i.e. stationary). However, alternatively the deformable non-deformable structures may be coupled to the board such that the structures are able to rotate about one or more axes with respect to the board, and/or move linearly with respect to the board.

4) A board according to an embodiment of the present invention may include deformable or non-deformable structures that can be attached to the board using respective interposers between the structures and the board which provide spring function, thereby allowing a user to make the apparatus bounce, upon applying a sufficient amount of force thereto.

5) In an embodiment, the deformable or non-deformable structures may include a spring function, thereby allowing the user to make the apparatus bounce, when the user applies force thereto.

6) In an embodiment, the deformable or non-deformable structures and/or or interposer(s) may include weights for the purpose of balancing the training board while the board is being used by the user. In an embodiment, the magnitudes of the weights, and the positions of the weights along the width and length dimensions of the board may be made adjustable to compensate for (a) irregularities of the board itself; (b) the conditions in which the board is being used (such as when the board is used on a slanted surface); (c) the characteristics of the user (height, weight etc.); and/or (d) the way in which the training board will be used.

7) In an embodiment, the training board may emulate a skate board in function and performance in a stationary position without the use of wheels, or other motion-enabling support elements.

8) In an embodiment, the training board may emulate a water board in function and performance.

9) In an embodiment, the training board may emulate a snow board in function and performance.

10) Stationary or Rotating Balls can be inflated to adjust the bounce & or tension.

11) Rotating balls can rotate in one or many planes relative to the board.

12) The balls that are attachable to the board can be deformable or non-deformable.

13) An embodiment may include the use of clips to secure that can secure a user's feet to the board.

14) An embodiment may include the use of roll limiters to define a range of motion in an axial plane (i.e. roll) and the balance of skateboard. Thus, the roll limiters may prevent the board from rotating beyond a pre-determined degree of angular rotation along the roll axis.

15) An embodiment may include spherical, cylindrical or disk shaped structures which may contain weights for providing balance. Alternatively or additionally, the structures of different shapes may include springs.

16) In an embodiment, the spring cavity, guideway, plunger and lower ring may act together to hold the spring in place throughout its entire range of motion.

17) Stabilizers may be provided which may be operable to control the roll and yaw of board with respect to the stator.

18) A compliant layer, referred to herein as a "shoe" may be placed between the stator (which may include deformable members) and the ground to provide stability and cushioning for the training apparatus.

One purpose of embodiments of the training device disclosed herein is to provide a safe method to train for sports that require a board such as skateboarding, snowboarding, wakeboarding and/or surfing. It also can be used as a therapeutic tool for proprioceptive training, postural reactions, coordinated muscle response and muscle strengthening.

The operation of the training device is preferably able to simulate the operational characteristics of boards used in athletic sports such as skateboarding, snowboarding, wakeboarding or surfing by placing springs between the base of training device and the board on which the user stands that compress in response to forces applied thereto by the user and which produce upward thrust as the springs extend again. Once the internal springs decompress, the board can be thrust into the air allowing the operator of the training device to perform aerial maneuvers and simulating tricks and stunts commonly practiced in the aforementioned board-related sports.

For example, a skateboarder could perform common tricks such as an "Ollie" or "kickflip" more safely when using a training device in accordance with an embodiment of the present invention than when using a real skateboard with wheels. The characteristics of the internal springs can be selected so as to produce a range of thrust force levels, ranging from a few pounds to more than four hundred pounds.

Figure 1B:
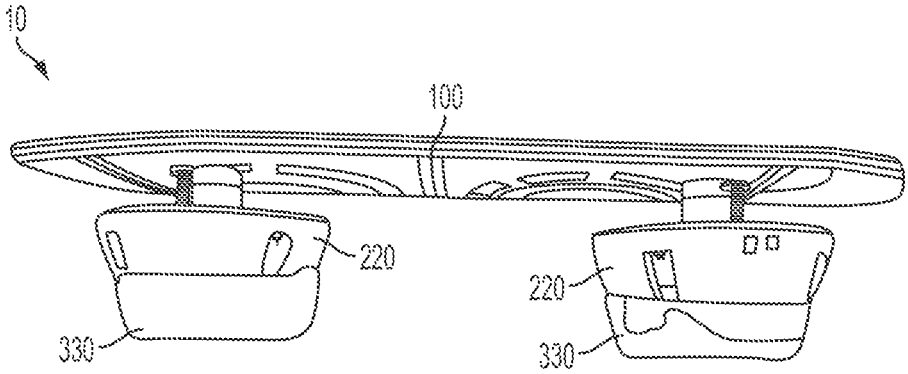
FIG. 1B is a side view of the training device of FIG. 1A.
Figure 1C:
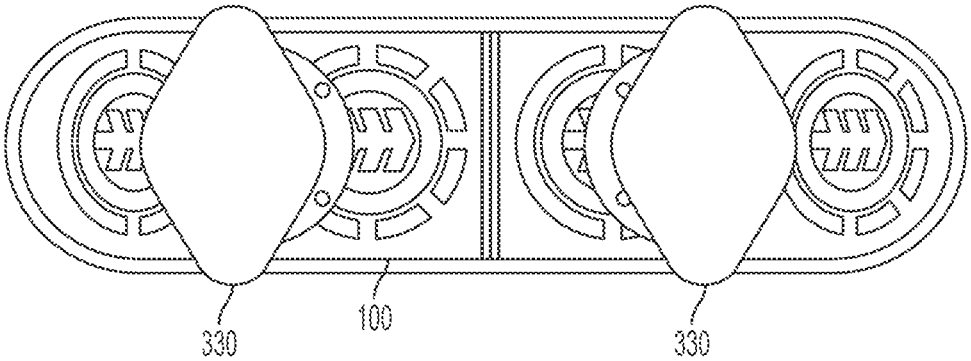
FIG. 1C is a bottom view of the training device of FIG. 1A in which the longitudinal axis of the training device and of the board extends from left to right, the lateral axis extends from top to bottom, and the vertical axis extends into and out of the page, in the view of FIG. 1C.

FIG. 1A is a frontal view of a portion of a training device 10 in accordance with an embodiment of the present invention. FIG. 1B is a side view of the training device 10 of FIG. 1A. FIG. 1C is a bottom view of the training device 10 of FIG. 1B.

The training device 10 of FIG. 1A may include board 100, spring ball 220, and shoe 330, which shoe may be made of polyurethane or other suitable rubber, or other suitably compliant material.

Figure 2:
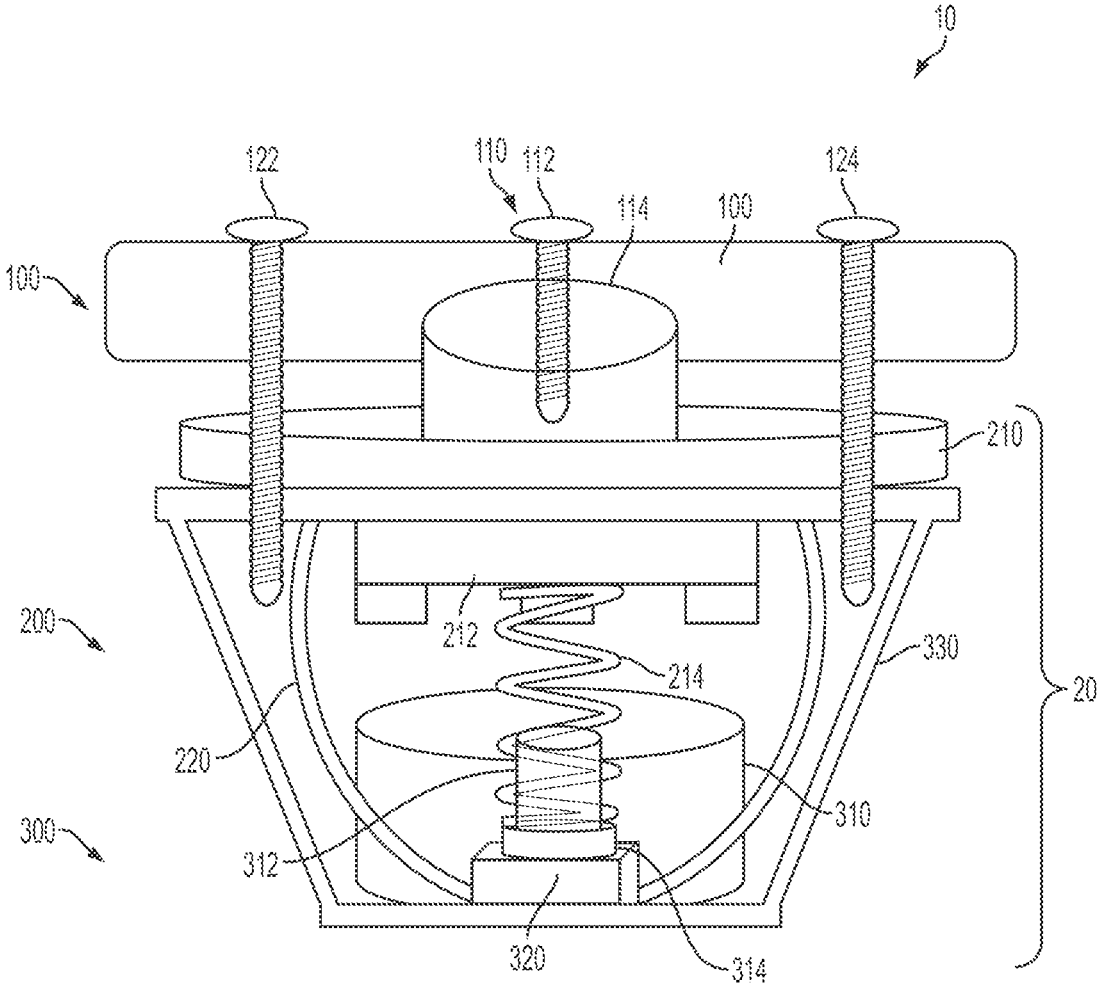
FIG. 2 is an elevational view of a portion of a training device having a board coupled to a stator in accordance with an embodiment of the present invention.

FIG. 2 is an elevational view of a portion of a training device 10 having a board 100 coupled to a stator 20 in accordance with an embodiment of the present invention. Training device 10 of FIG. 2 may include board 100, suspension linkage 200 (also referred to as a suspension linkage assembly), and base 300. Stator 20 may include suspension linkage 200 and base 300.

Board 100 may include anchor 110, anchor screw 112, anchor shaft 114, stabilizer screws 122, 124 and corresponding stabilizer holes 126 and 128. Suspension linkage 200 may include top ring 210, plunger 212, spring 214, and spring ball 220. Base 300 may include spring cavity 310, spring guideway 312, bottom ring 314, pedestal 220, and shoe 330. Herein, the combination of the stabilizer screws and stabilizer holes may be referred to as a stabilizer assembly.

Figure 3:
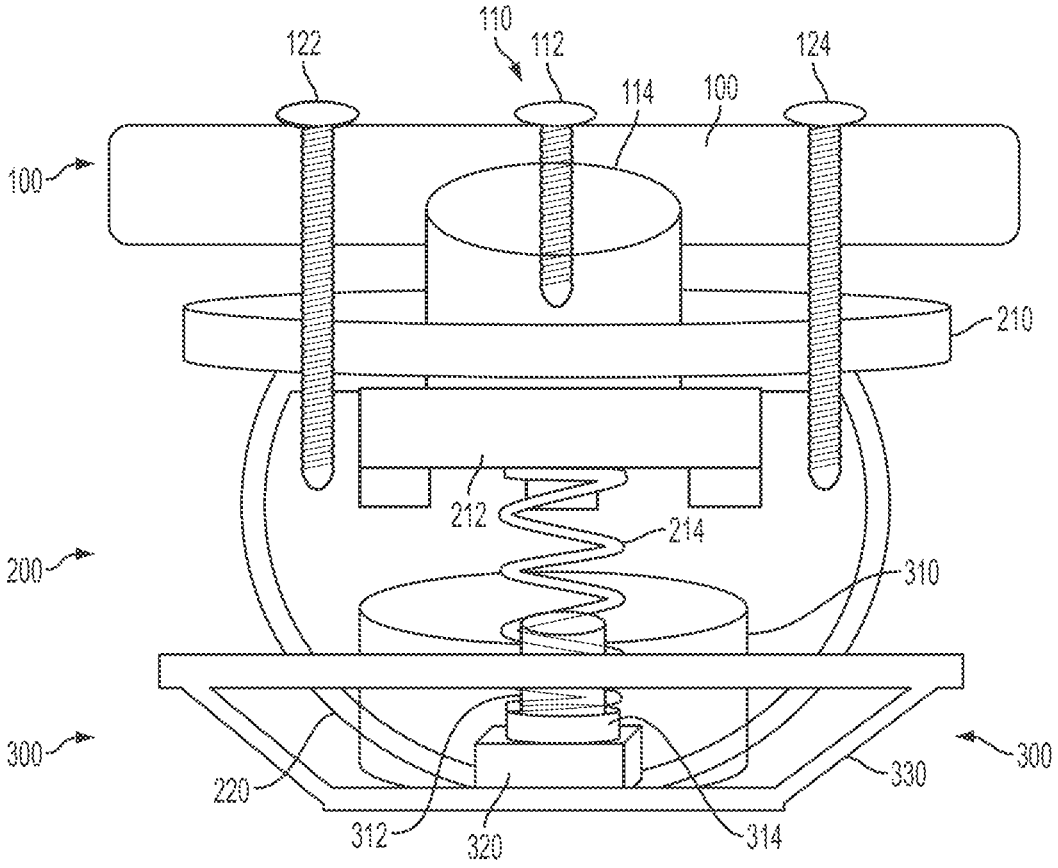
FIG. 3 is an elevational view of the training device of FIG. 2 having a different sized shoe attached thereto than the training device embodiment shown in FIG. 2.

FIG. 3 is an elevational view of the training device 10 of FIG. 2 having a different sized shoe 330 attached. For the sake of brevity, the discussion of parts shown in FIG. 3 that are unchanged with respect to those shown in FIG. 2 is not repeated in this section. In the embodiment of FIG. 3, it may be seen that shoe 330 has a reduced vertical profile, rising to a vertical level just below the upper edge of the spring cavity 310.

Figure 4:
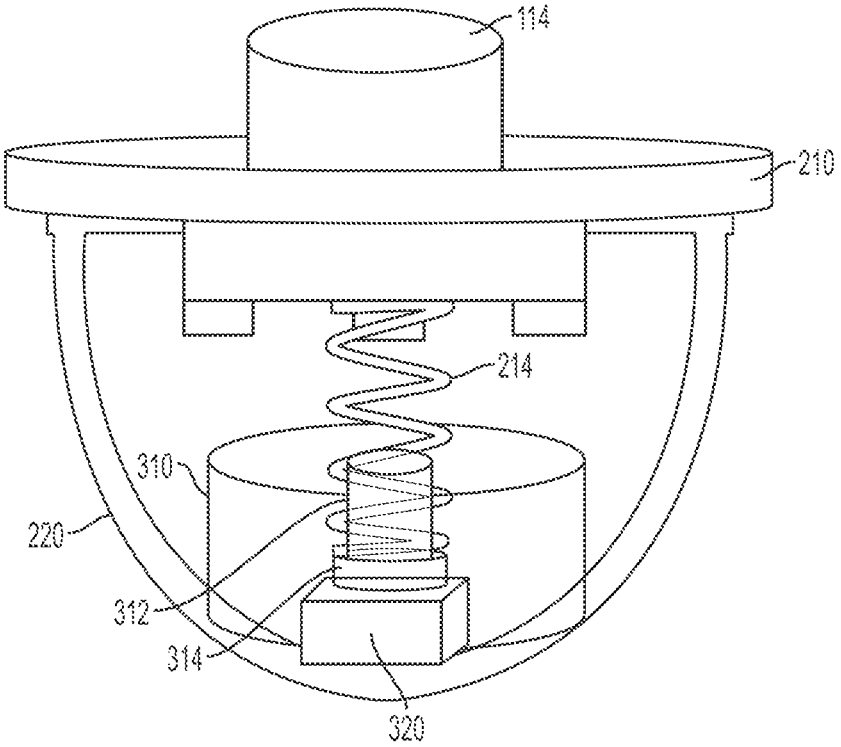
FIG. 4 is an elevational view of a portion of the stator of the training device of FIG. 2.

FIG. 4 is an elevational view of a portion of the stator 20 of the training device 10 of FIG. 2. FIG. 4 shows the spring 214 and spring guideway 312 in greater detail. In this embodiment, as upper ring 210 is forced downward against the force of spring 214, the coils of spring 214 will wrap around spring guideway 312, and the outer diameter of spring 214 will be located well within the interior of spring cavity 310.

Figure 5:
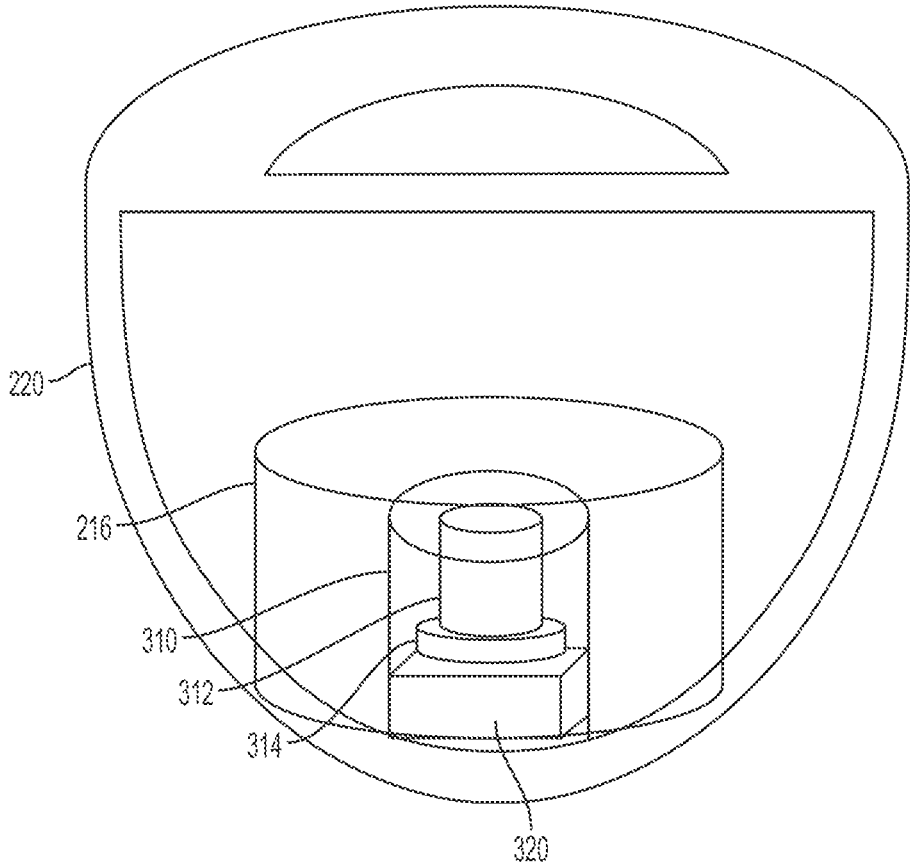
FIG. 5 is an elevational view of a portion of the stator of the training device of FIG. 2.

FIG. 5 is an elevational view of a portion of the stator 20 of the training device of FIG. 2. FIG. 5 shows spring ball 220, plunger cavity 216, spring cavity 310, spring guideway 312. and bottom ring 314.

Figure 6:
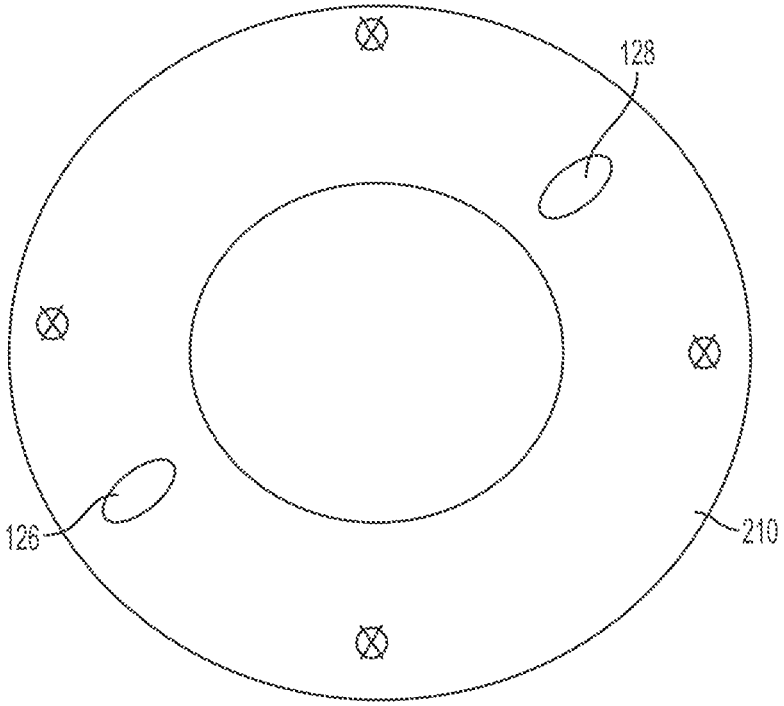
FIG. 6 is a plan view of a top ring portion of a suspension linkage structure of the embodiment shown in FIG. 2.
Figure 7A:
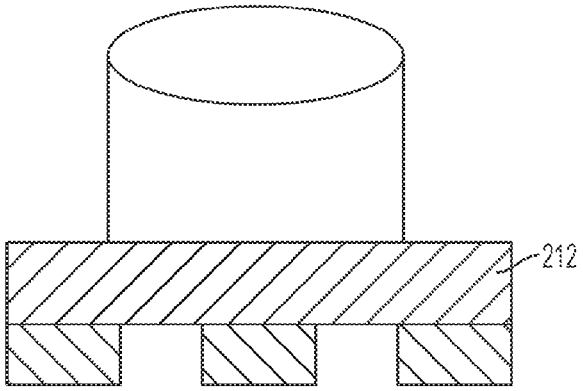
FIG. 7A is an elevational view of the plunger included in the training device of FIG. 2.
Figure 7B:
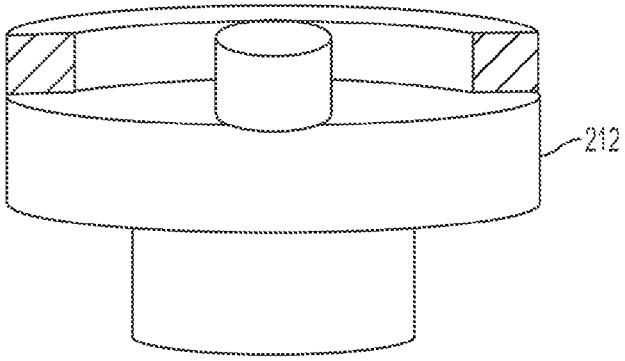
FIG. 7B is partially elevational and partially sectional view of the plunger of FIG. 7A.
Figure 7C:
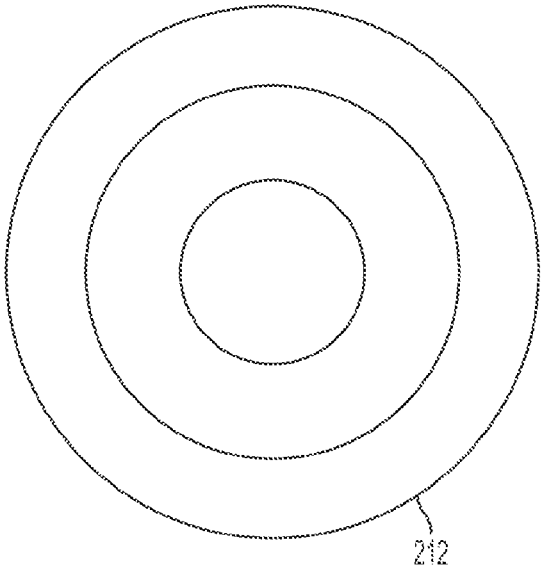
FIG. 7C is a top view of the plunger of FIG. 7A.

FIG. 6 provides a detailed view of top ring 210 and of holes 126, 128 through which stabilizer bars may be inserted.

The internal mechanisms of the stator which include the metal plunger, top and bottom rings & polyurethane shoe, may provide a safe and reliable method for thrusting the board into the air as the operator performs maneuvers. The design and construction, combined with the type of material selected for the stator, anchor and stabilizers preferably produce a rugged apparatus that can withstand the pounding of the apparatus on any surface the operator chooses to train on in surface streets or parks. The anchor and stabilizers may be made out of aluminum and/or steel. The various stator components may include metals, plastics, and/or rubber.

A more detailed description of the training device 10 follows. In one embodiment, two stators may be rigidly attached to the board 100 (such as, via the anchor), and the internal mechanisms of the stator 20 allow the springs to be independently compressed based on the location and the amount of force that gets applied to the board. The shoes 330 and stabilizers preferably provide cushioning and stability.

The shoes 330 may serve multiple purposes. The shoes 330 may absorb some of the force (by deforming) of impact when the training device 10 strikes a ground surface after the device 10 has been thrust in the air, thereby providing cushioning. The shoes 330 may also limit the amount of pitch and roll the training device 10 will experience when an operator is on top of the board and the training device is making contact with a ground surface, thereby providing stability. The stabilizers limit the amount of yaw the training device 10 will experience while the operator is on top of the board and the apparatus is making contact with a ground surface. The stabilizers preferably provide stability by preventing the shoes 330 from rotating relative to the board.

The shape of the shoes may help determine the amount of pitch and roll the training device 10 will experience with an operator on top of the board while the training device 10 is making contact with a ground surface. The thickness of the shoes 300 may determine how much impact can be absorbed by the shoes 330, which absorption provides cushioning and prevents the stator from being damaged.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for training purposes, comprising:

a board with an upper surface, a bottom surface, a first end, and a second end, the upper surface of the board providing space for the placement of one or more feet of a user;

at least one deformable, substantially round member coupled to a mount that is in turn coupled to the bottom surface of the board;

wherein the deformable member enables movement of the board relative to a ground surface in response to force applied to the board by a user;

wherein the device comprises at least two deformable members in the form of spherical balls; and wherein the spherical balls are rotatable in at least one dimension with respect to the board.

2. A device for training purposes, comprising:

a board with an upper surface, a bottom surface, a first end, and a second end, the upper surface of the board providing space for the placement of one or more feet of a user;

at least one deformable, substantially round member coupled to a mount that is in turn coupled to the bottom surface of the board;

wherein the deformable member enables movement of the board relative to a ground surface in response to force applied to the board by a user;

wherein the device comprises at least two deformable members in the form of spherical balls; and wherein the spherical balls are rotationally fixed with respect to the mount and the board.

3. The device of claim 1 further comprising an anchor between the mount and its corresponding spherical ball.

4. The device of claim 3 further comprising a suspension linkage extending from the anchor to the spherical ball to provide compliance in a direction perpendicular to the bottom surface of the board.

5. The device of claim 4 wherein the suspension linkage comprises a coil spring.

6. The device of claim 4 wherein the suspension linkage enables rotational movement of the board along at least one of roll, pitch, and yaw axes with respect to the ground surface on which the device is located.

7. The device of claim 4 further comprising:

a shoe made of compliant material affixed to a bottom of the spherical balls to provide cushioning for the device.

8. The device of claim 7 wherein the shoe is made of polyurethane.

9. The device of claim 5 wherein the coil spring is operable to allow the board to move toward a base of the training device in response to force from the user.

10. The device of claim 9 further comprising a stabilizer assembly that is operable to allow the board to rotate with respect to the base along the pitch axis, but not along the yaw or roll axes.

11. A training device for emulating the operation of an athletic board device, the training device comprising:

a board with an upper surface, a bottom surface, a first end, and a second end, the upper surface of the board being configured to receive a user's feet thereon;

a base configured to be placed on a solid surface; and at least two suspension linkage assemblies coupling the board to the base and operable to provide linear compliance at least in the vertical dimension, each said suspension linkage assembly comprising:

a spring operable to compress in response to force applied on the board by the user and to re-extend as the user-applied force recedes; and a deformable spring ball coupled to the spring operable to provide compliance in at least two linear dimensions.

12. The training device of claim 11 further comprising:

a compliant layer substantially surrounding the deformable spring ball.

13. The training device of claim 12 wherein the compliant layer is operable to cushion an impact of the training device against a hard ground surface underneath the shoes.

14. The training device of claim 12 wherein the compliant layer is made of polyurethane.

15. The training device of claim 11 further comprising:

a stabilizer assembly operable to limit rotational motion of the board with respect to the suspension linkage and the base.

16. The training device of claim 15 wherein the stabilizer assembly is operable to limit rotation of the board with respect to the base about the yaw and roll axes of the training device.

17. The training device of claim 11 wherein the deformable spring balls are made of one or more materials selected from the group consisting of: (a) rubber; (b) plastic; (c) wood; and (d) metal.

* * * * *